US011299321B2

(12) United States Patent
Vaeth

(10) Patent No.: US 11,299,321 B2
(45) Date of Patent: Apr. 12, 2022

(54) MODULAR PALLET SYSTEM FOR TRANSPORTING BULKY AND FRAGILE GOODS IN A MULTI-STORY CONSTELLATION

(71) Applicant: Naqel Co., Riyadh (SA)

(72) Inventor: Dittmar Vaeth, Riyadh (SA)

(73) Assignee: NAQEL CO., Riyadh (SA)

( * ) Notice: Subject to any disclaimer, the term of this patent is extended or adjusted under 35 U.S.C. 154(b) by 0 days.

(21) Appl. No.: 16/911,019

(22) Filed: Jun. 24, 2020

(65) Prior Publication Data

US 2020/0407110 A1 Dec. 31, 2020

(30) Foreign Application Priority Data

Jun. 25, 2019 (GC) ..... 201937835

(51) Int. Cl.
*B65D 19/12* (2006.01)
*B65D 19/00* (2006.01)

(52) U.S. Cl.
CPC ..... *B65D 19/12* (2013.01); *B65D 19/0063* (2013.01); *B65D 2519/00024* (2013.01); *B65D 2519/0097* (2013.01); *B65D 2519/00203* (2013.01); *B65D 2519/00273* (2013.01); *B65D 2519/00572* (2013.01)

(58) Field of Classification Search
CPC ..... B65D 19/44; B65D 19/385; B65D 2519/00233; B65D 2519/00542; B65D 2519/00577; B65D 2519/00582; B65D 2519/00606; B65D 2519/00626; B65D 2519/00671; B65D 2519/00676; B65D 2519/00696; B65D 19/12; B65D 19/0063; B65D 2519/00024; B65D 2519/00203; B65D 2519/00273; B65D 2519/00572; B65D 2519/0097
See application file for complete search history.

(56) References Cited

U.S. PATENT DOCUMENTS 4,261,470 A * 4/1981 Dolan ..... F16B 7/22 211/191
4,838,178 A * 6/1989 Chriske ..... B65D 19/0026 108/55.1
2004/0168946 A1* 9/2004 Angeletti ..... B65G 49/062 206/448
2014/0133952 A1* 5/2014 Carling ..... B65D 19/0073 414/800

* cited by examiner

*Primary Examiner* — Matthew W Ing
(74) *Attorney, Agent, or Firm* — Westman Champlin & Koehler, P.A.

(57) ABSTRACT

Modular pallet system for transporting bulky and fragile goods in a multi-story constellation, the system consists of the modules basic-pallet, vertical-pillars, longitudinal-reinforce-elements and transversal-reinforce-elements. The basic-pallet provides the surface for placing the cargo and for lashing via integrated tie-down points. Further junction points at the edges of the basic-pallet are for the connection with the vertical-pillars and through these with the reinforce elements, necessary to provide the assembly's stability, enabling stack ability with additional basic-pallets on top.

20 Claims, 5 Drawing Sheets

MODULAR PALLET SYSTEM FOR TRANSPORTING BULKY AND FRAGILE GOODS IN A MULTI-STORY CONSTELLATION

FIELD OF INVENTION

The present invention relates to a modular pallet transport system, to be assembled in a toolbox principle, suitable especially for the transport of big and bulky goods and capable to be stapled also with heavy payload in a transport vehicle or in a transport compartment.

BACKGROUND OF THE INVENTION

The transport of goods over long distances became multiplicative in-between the last decades. Especially in the manufacturing industry, components for the production as well as finished products are partially transported around the globe. A very important feature in this context is the efficient use of the available space in the transport vehicle as well as a fast handling of the regarding goods. A number of standard loading-devices as Euro-Pallet systems and regarding accessories have been firmly established for a long time too. For the transport of goods with extended dimensions in comparison, these standard loading-devices are suitable to only a limited extent. In cases where loaded standard-pallets are in need to be stacked, traditional systems are reaching quickly their limits, because in many cases the required stability or tilt resistance is no more ensured. Determinant values are mentioned in regarding rules and standards, displaying the maximum allowed acceleration/deceleration of the payload transported with the respective transport vehicle (truck, train, ship, and aircraft).

The prior art references have dealt with other examples of transporting system as follows:

The patent application no. (FR2774971) discloses a group of frames configuration pallet system, comprises lower and upper chassis formed from welded tubular elements. The lower chassis has an upper frame with angle sections and a lower frame with braces connected by steel sheets and legs. The upper chassis comprises a peripheral frame with lugs for the centralizing and fixing of optional separators. There are notches for the passage of rubber pegs for supporting the load.

Also, the patent application no. (US2012145031) discloses a pallet Handling System (PHS) of a ship, the invention proposes that the driving means which drives the payload support platform along a rail is also used to move that rail relative to the payload support platform and a support rail so that the position of the rail can be changed during the movement of the payload support platform between one site and another, the payload support platform is lockable to the support rail, such that the force which drives the payload support platform along the rail changes to driving the rail relative to the support rail.

The patent application no. (U.S. Pat. No. 5,868,080) discloses pallets for storing and transporting goods, and more particularly, to A reinforced plastic pallet construction and assembly method are presented wherein multiple reinforcing bars are employed, at least some of the reinforcing bars having an exposed surface at a top surface, underneath surface or bottom surface of the pallet. In addition to functioning as a reinforcing member, the exposed surfaces of the reinforcing bars comprise an anti-skid surface for maintaining positioning of payload on the pallet or facilitating transport of the pallet, e.g., via a forklift or automated transport system. Various techniques for retaining the reinforcing bars within channels formed in the plastic pallet body. The reinforcing bars preferably comprise composite structural members of fiberglass reinforced plastic.

Also, the patent application no. (GB2526704) is directed to a collapsible tubular sleeve has apertures suitable to receive fork lift tines and a lid engages its upper edge. The lower edge of the sleeve can rest on the ground around a pallet. Engagement between the sleeve and lid can be in the form of a downwardly facing channel on the lid or a horizontally facing channel on the wall. The sleeve could be formed of various plastics, card, and layers of corrugated card, metal or plywood. Panels of the sleeve could be cut from a single blank and connected by hinges comprising fold lines and adhesive or a releasable latch at an overlap portion. A waterproofing coating such as wax, resin or paint could be applied. The corrugations could receive reinforcing filler or rods. The lid could be formed of various materials such as multilayer corrugated card, fiber reinforced plastic or wooden slats and a lip could be formed of L shaped plastic or paper pulp members attached by adhesive or screws. There can be insulation within the sleeve and/or around it in the form of wrapping or plates engaged with internal U-shaped channels at either end of each panel. An aperture could allow access and coolant packages could be provided in within the sleeve.

The patent application no. (US2012145031) discloses a shipping assembly for shipment of elongated containers of semi-rigid material by securing a plurality of like dimensional containers into an integral bundle, said shipping assembly comprises: a plurality of longitudinally spaced parallel base pads, having oppositely disposed pairs of upstanding support tubes extending therefrom, connecting elements interconnecting some of said upstanding support tube pairs, a plurality of corner flaps on the ends of said connecting elements an elongated pallet overlying said base pads and said base board, end cap assemblies extending over some of said support tubes and related base pads, means for inter engaging said end cap assemblies and said elongated pallet and upstanding support tube pairs on said integral bundle of like dimensional containers, and means for securing said shipping assembly about said integral bundle.

The problem experienced in the previous prior art, discloses pallets as a consumable packaging cost. as products supplied on non-returnable pallets and in order to keep costs to a minimum, the pallets are made light in weight and with only sufficient strength to carry the load of the goods being loaded.

Another problem experienced, that pallets are bulky by their nature (which is to provide an elevated load platform with space underneath for lifting forks) and unloaded pallets thus occupy large volumes.

Also, one of the problems is that the pallet system disclosed in the applications with different standard pallet sizes that are used for different types of goods, load weights, storing configurations (e.g. with or without stacking and/or racking), etc. The space constraints in different areas where the payload need to be stored vary from one pallet to another.

The present invention seeks to address the shortfalls mentioned above, including providing cost effective, light weight pallets with good load carrying abilities, providing convenient and cost effectiveness use of pallets by reducing the weight of pallets during transportation, capable for all kind of goods that cannot be stacked by using standard pallet systems.

SUMMARY OF THE INVENTION

There is disclosed herein a modular pallet system suitable especially for the transport of big and bulky goods and capable to be stapled also with heavy payload comprising modules of basic-pallet, vertical-pillars, longitudinal-reinforce-elements and transversal-reinforce-Elements. The Basic-Pallet provides the surface for placing the cargo and for lashing via integrated tie-down points.

Further junction points at the edges of the Basic-Pallet are for the connection with the Vertical-Pillars and through these with the Reinforce-Elements, necessary to provide the assembly's stability, enabling stack ability of multi-story structure with additional Basic-Pallets on top.

Because of the modular design of the said pallet-system, the modules are combined in a way, to fit in the dimensions of the payload in the best way, whereby the regarding modules are put together by a "toolbox" principle into one or more combined assemblies. A special attention by developing this pallet-system has been taken onto the (empty) carriage of the modules, which can be performed in a quite space-saving way.

The "basic pallet" module (P) is made of solid steel frame with 2 wooden top surfaces, can be painted or hot dip galvanized. Staple dimension=(80-220) mm/pallet. The connection with the vertical pillar module (VP) and the transversal reinforce module (RT) takes place via standard-screws (M8 up to M36) or alternative via plug-connection. The modules "vertical-pillar" (VP) & "reinforce-longitudinal" (RL) comprising steel beams connected via screws or plug system. The connection of module (VP) with (RL) takes place via standard-screws (M8 up to M36), the connection of module (P) with module (RT) takes place via standard-screws (M8 up to M36). Alternative the modules can be connected via plug connection, with exception of connection (VP) with (RT), which needs to be screwed only (M8 up to M36), because of a very rigid connection, needed at this specific position. The module (VP) is available in different lengths, i.e. the specific module can be selected individually conform to the height of the payload. The length of the regarding module is specified by a number after the code designation. Example: VP–(500-1800)=Vertical-Pillar with a length of (500-1800) mm.

The module "reinforce-transversal" (RT) is made of steel element needed to absorb transversal forces. The connection of the basic pallet (P) takes place via standard-screws (M8 up to M36), or alternative via plug-connection. The connection of the vertical pillar (VP) takes place with standard-screws (M8 up to M36) only. All the modules can be painted or hot dip galvanized.

The dimensions of the modules designed to have technical specifications shown as the following:

| Module: | Basic Pallet (P) |
|---|---|
| Dimensions (l × b × h): | (600-2,200) × (600-2,200) × (40 × 250) mm |
| With payload: | (10-2,200) mm |
| Load capacity: | up to 10,000 kg |
| Weight: | 15 up to 300 kg |
| Description: | Wood surface optional with plywood board, OSB board or solid wood board |
| Module connection: | via standard screws (M8 up to M36) or alternative via plug connection |
| **Module:** | **Vertical Pillar (VP)** |
| Height (h): | 500-1800 mm |
| Load capacity: | up to 10,000 kg with all 4 pillars |
| Weight: | 15 up to 300 kg |
| Module connection: | via standard screws (M8 up to M36) or alternative via plug connection with module P via standard screws (M8 up to M36) with Module RT only |
| **Module:** | **Longitudinal Reinforce Module (RL)** |
| Dimensions (l × h): | (350-2,000) × (350-2,000) mm |
| Tilt capacity: | up to 100 kg longitudinal force |
| Weight: | 15 up to 200 kg |
| Module connection: | via standard screws (M8 up to M36) or alternative via plug connection |
| **Module:** | **Transversal Reinforce Module (RT)** |
| Length (l): | 350-2,200 mm |
| Tilt capacity: | up to 100 kg transversal force |
| Weight: | 15 up to 200 kg |
| Module connection: | via standard screws (M8 up to M36) or alternative via plug connection with module P via standard screws (M8 up to M36) with Module VP only |

Example (1): Alternative pallet widths can be offered 600 mm or 800 mm particularly suitable for the transport of motor bikes, 1.150 mm for the use in sea-containers (optimum use of the inner width) 1.600 mm wider version (inside the truck space is still available for a 600 mm or a 800 mm wide unit beside) 2.100 mm for the transport of cars.

Example (2): If the loading of a 13.60 m mega-trailer with a maximum inner loading height of 3.00 m is assumed, the suggested payload components of the construction business are transported. The "Module combination" comprises the number and the code designation of the modules, as (P), (V), (RL) and (RT) for the particular assemblies are mentioned. The number after (VP) specifies the length of the vertical pillar.

e.g. 1×P/4×VP-1200/2×RL/2×RT

1× Basic-pallet module, 4× Vertical pillar module with length 1.200 mm, 2× Longitudinal reinforce module, 2× Transversal reinforce module.

For the return transport or for the transport to the next loading place, all utilized pallets (empty) as well as all additional modules are in need of a loading space of 1.20×1.20×3.00 m (l×w×h), which is equivalent to the "footprint" of one single basic-pallet (P). For stacking the basic-pallets (P), the upper one has to be positioned with a displacement of 90° in comparison with the lower one.

For load securing, the payload is secured via the suspension points on the basic-pallet (P) and at the other hand, the pallet combinations are secured via the suspension points on the loading floor of the semi-trailer. Therefore standard lashing belts with tensioning devices are used. At the pallet combinations themselves, many positions are capable for placing the hook of a lashing belt.

For mounting and handling of the pallet combinations, 2 variations can take place, at the first variation, the modules or respectively one pallet combination with the other, are connected via standard-screws (M12) and (M16), whereby a rigid "mono block" situation occurs. The drawings conform are giving a visual impression for this kind of connection the ("screwed only").

At the second variation, the connecting points of the modules are equipped with conic aligned bolts, whereat the modules needs to be plugged only and whereby the modules can be mounted much faster and easier. Also stacking the combinations via forklift becomes easier. The only position, which is in need to be screwed only, is the connection of the vertical-pillar module (VP) with the transversal reinforce module (RT), because at this position a quite rigid connection is required. The drawings conform ("screwed/plugged") are giving a visual impression for this kind of connection.

Additional modules and accessories can be offered, e.g. adapter-beams, which will be connected with the basic pallet for transporting special goods, e.g. wheeled vehicles or engineering elements. Suchlike adapter beams will be connected with the basic pallet via screw-connection. Regarding connecting points are already foreseen at the basic-pallet for fixing the wooden panels, i.e. these wooden panels will be off-mounted and replaced with the regarding adapter beam. Also lifting accessories for lifting via crane.

DETAILED DESCRIPTION OF DRAWINGS

Figure 1:
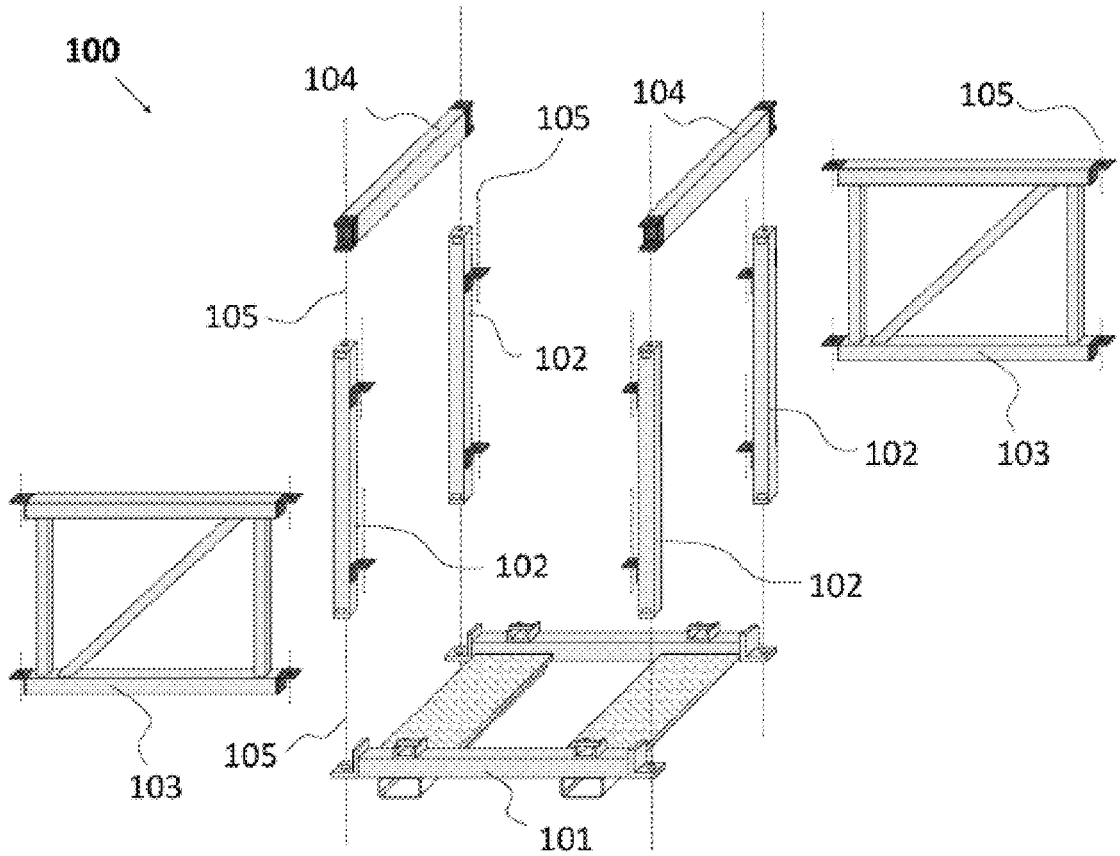
FIG. 1 illustrates all modules view with all the main components of the Pallet System.

Referring to FIG. 1, the pallet system comprising a basic-pallet 101, vertical-pillars 102, longitudinal-reinforce-elements 103 and transversal-reinforce-elements 104. The position 105 stands for the connecting system, which is used for getting all modules assembled together.

Figure 2:
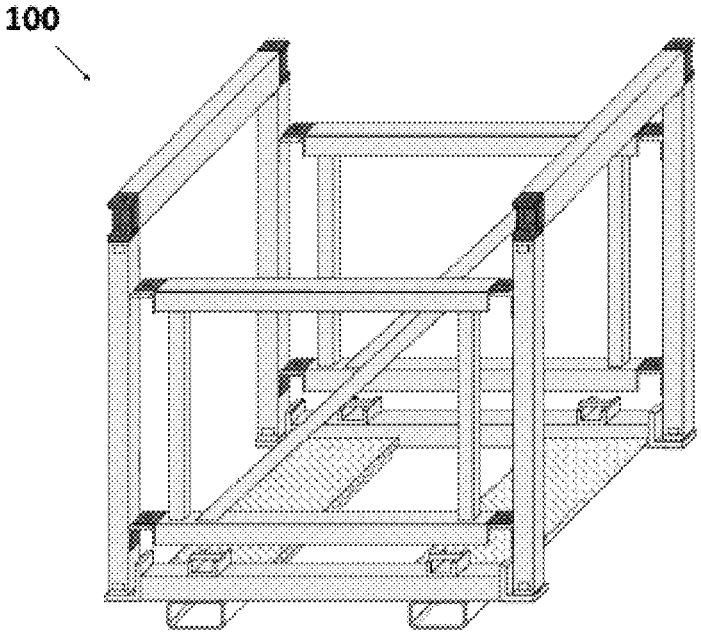
FIG. 2 shows the view of all modules interconnected into one possible assembly.

Referring to FIG. 2, the illustration demonstrates that the basic-pallet 101 can also be utilized without any additional other module, e.g. at the top position of a stacked pallet pile. A single pallet as well as a stacked Pallet pile can be anchored via standard lashing material against the vehicle's tie-down-points.

Figure 3:
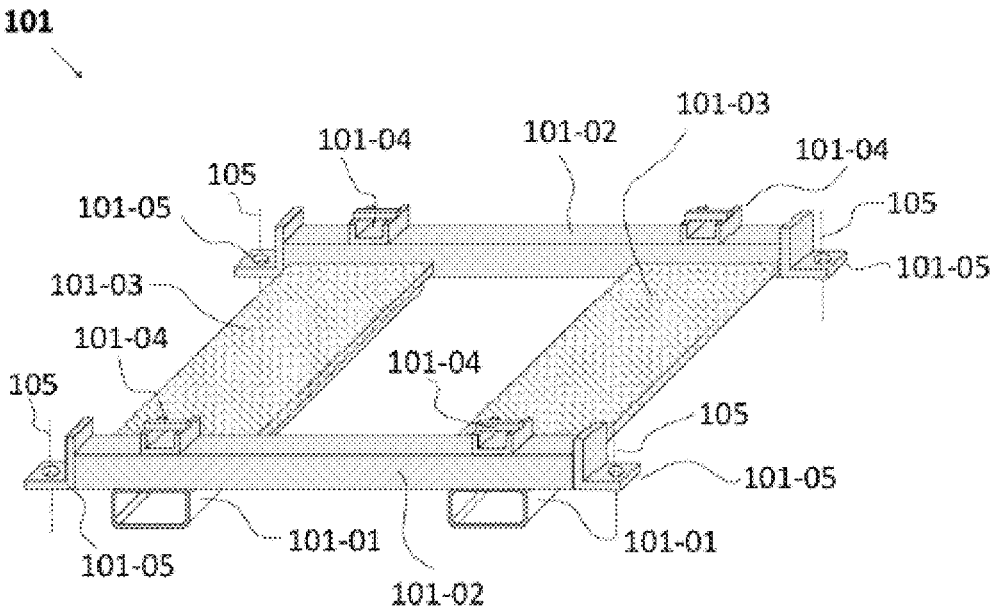
FIG. 3 shows the Basic-Pallet and its elements forming a frame are also foreseen as forklift pockets at handling duties with the forklift.

Referring to FIG. 3, the basic pallet comprising square tubes 101-01 and 102-02 in form of a rigid frame, whereby the square tubes 101-01 are in the form of a forklift pockets at handling duties with the forklift. The tie-down-points 101-04 are taking place for lashing the placed cargo. The junction-points 101-05 are taking place for connecting the vertical-pillars 102 via the connecting variations 105. On top of the rectangular pipes 101-01, an anti-slippery surface 101-03 is mounted, which can be made of plywood or of other alternative materials. The dimensions of the basic-pallet 101 are determined in order of the scope of application and are therefore variable. Instead of the anti-slippery surfaces 101-03, customized adapters for special requirements can be connected alternatively.

Figure 4:
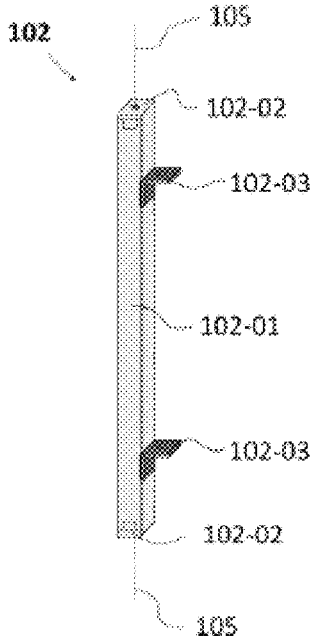
FIG. 4 illustrates the Vertical-Pillar in the form of a square tube with solid end plates.

Referring to FIG. 4, the vertical-pillar 102 made of square tube 102-01 and 102-02 with internal threads for the connection via 105 with the junction-point 101-05 of the basic-pallet 101 at one end and with the transversal-reinforce-element 104 at the other. The junction-points 102-03 are for the connection with the longitudinal-reinforce-element 103. The dimensions of the vertical-pillars 102 will be determined depending on the scope of application and are therefore variable.

Figure 5:
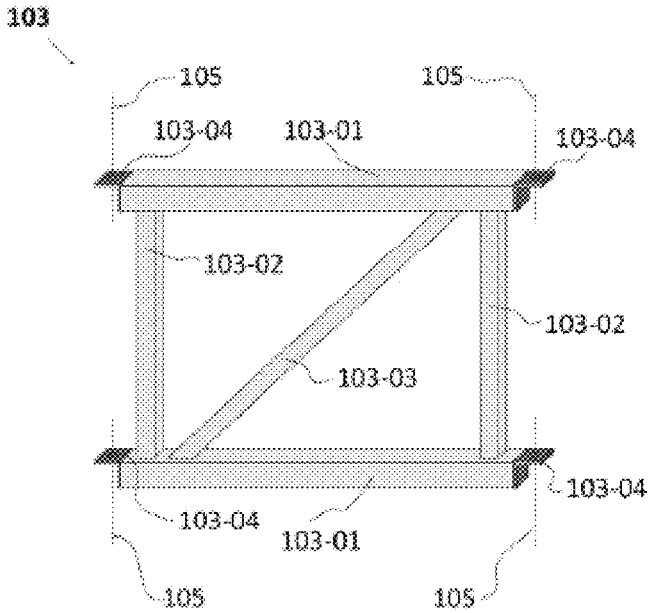
FIG. 5 shows the Longitudinal-Reinforce-Element made of square tubes with different Sizes.

Referring to FIG. 5, the longitudinal-reinforce-element 103-01, 103-02 and 103-03. The junction-points 103-04 are for the connection with the vertical-pillar 102. The dimensions of the longitudinal-reinforce-element 103 will be determined depending on the scope of application and are therefore variable.

Figure 6:
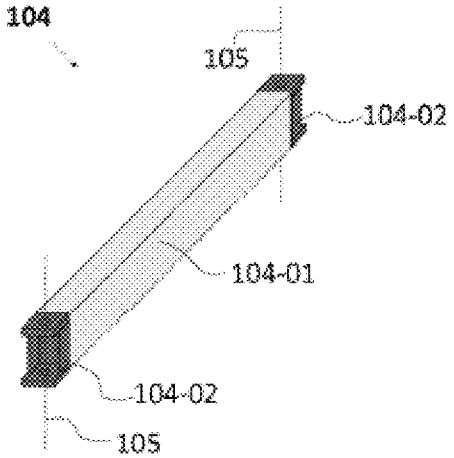
FIG. 6 shows the Transversal-Reinforce-Element made of square tube and with very solid and stiff junction-points on each end.

Referring to FIG. 6, the transversal-reinforce-element 104 made of square tube 104-01 and with very solid and stiff junction-points 104-02 on each end. These junction points are for the connection with the Vertical-Pillars 102. The dimensions of the Transversal-Reinforce-Element 104 will be determined depending on the scope of application and are therefore variable.

Figure 7:
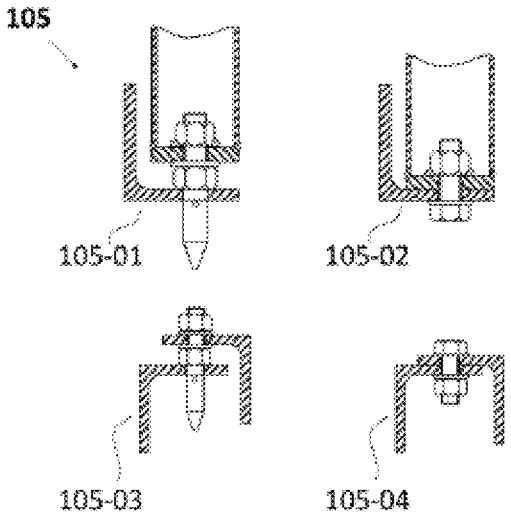
FIG. 7 shows 2 different ways to connect the modules together.

Referring to FIG. 7, the illustration demonstrates 2 different ways to connect the modules together. One way is by using a plugs system conform 105-01 and 105-03, the other way is by using standard screws conform 105-02 and 105-04. For the connection of the Transversal-Reinforce-Element 104 with the Vertical-Pillar 102, the only possible way is by using standard screws conform 105-02 only, because a very rigid connection is required at this specific position. The size of the connection elements conforms 105 will be determined depending on the scope of application and is therefore variable.

Figure 8:
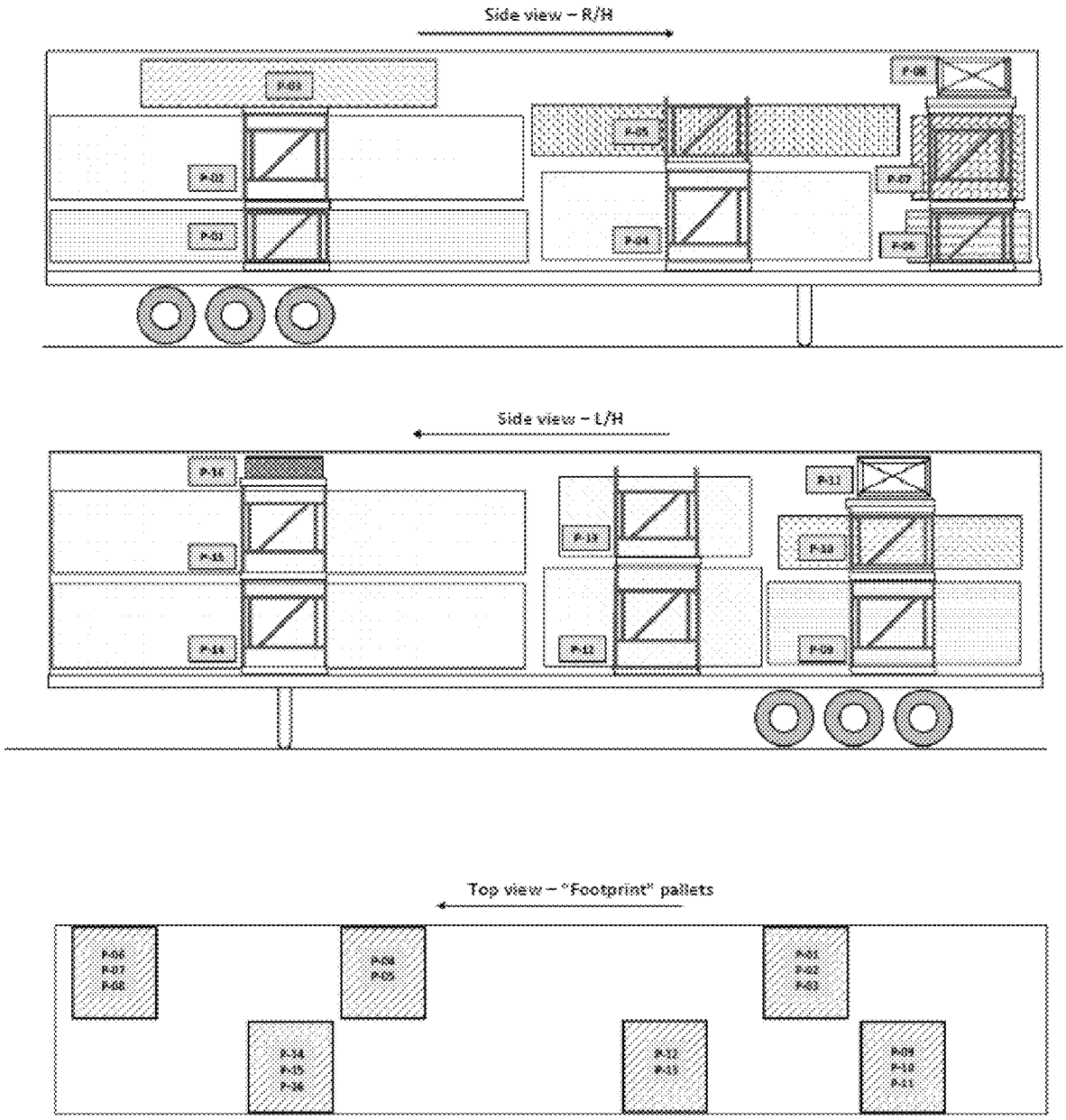
FIG. 8 shows the side view of truck carrying payload and pallet-assemblies conform.

Details for other embodiments of payload and pallet-assemblies conform as shown in FIG. 8:

| | | Assumed loading dimensions (mm) | | | Pallet assembly |
|---|---|---|---|---|---|
| Pal. no. | Payload | Length | Width | Height | Module combination |
| P-01 | Steel profiles | 6.600 | 1.080 | 750 | 1xP/4xVP-800/2xRL/2xRT |
| P-02 | Sandwich panels | 6.500 | 950 | 1.150 | 1xP/4xVP-1200/2xRL/2xRT |
| P-03 | Wooden profiles | 4.000 | 1.000 | 700 | 1xP |
| P-04 | Sandwich panels | 4.500 | 1.050 | 1.100 | 1xP/4xVP-1200/2xRL/2xRT |
| P-05 | Tubes | 5.000 | 1.080 | 700 | 1xP/4xVP-800/2xRL/2xRT |
| P-06 | Laminate floor surface | 1.700 | 1.020 | 650 | 1xP/4xVP-800/2xRL/2xRT |
| P-07 | Termopan windows | 1.500 | 980 | 1.170 | 1xP/4xVP-1200/2xRL/2xRT |
| P-08 | Small parts on europallet | 1.200 | 800 | 600 | 1xP |

-continued

| Pal. no. | Payload | Assumed loading dimensions (mm) Length | Width | Height | Pallet assembly Module combination |
|---|---|---|---|---|---|
| P-09 | Steel profiles | 3.500 | 1.080 | 1.100 | 1xP/4xVP-1200/2xRL/2xRT |
| P-10 | Wooden profiles | 3.400 | 960 | 800 | 1xP/4xVP-800/2xRL/2xRT |
| P-11 | Small parts on europallet | 1.200 | 800 | 600 | 1xP |
| P-12 | Sheetrock panels | 3.000 | 1.070 | 1.350 | 1xP/4xVP-1400/2xRL/2xRT |
| P-13 | Termopan windows | 2.600 | 980 | 1.100 | 1xP/4xVP-1200/2xRL/2xRT |
| P-14 | Sandwich panels | 6.500 | 950 | 1.150 | 1xP/4xVP-1200/2xRL/2xRT |
| P-15 | Sandwich panels | 6.500 | 950 | 1.150 | 1xP/4xVP-1200/2xRL/2xRT |
| P-16 | Tools in toolbox | 600 | 1.000 | 350 | 1xP |

I claim:

1. A modular pallet transport system comprising:

a basic-pallet arranged to accommodate a payload in a transport vehicle, wherein the basic-pallet comprises an open face, and wherein the basic-pallet comprises:

a rigid frame comprising a pair of end tubes spaced apart and parallel to each other;

a pair of surface members spaced apart from each other defining a gap therebetween and are positioned between and connected to the pair of end tubes; and a pair of forklift pocket tubes positioned under at least one of the pair of end tubes;

a plurality of vertical-pillars upwardly extending from ends of the basic-pallet;

a plurality of longitudinal-reinforce-elements connected to the pair of vertical-pillars, wherein each longitudinal-reinforce-element is positioned between a pair of the plurality of vertical-pillars, and wherein the plurality of longitudinal-reinforce-elements are suspended above the basic-pallet and without contacting the basic-pallet;

a first plurality of junction-point coupling members connected to only a single surface of each of the plurality of vertical-pillars, wherein the first plurality of junction-point coupling members support the plurality of longitudinal-reinforce-elements; and a plurality of transversal-reinforce-elements positioned on top of the plurality of vertical-pillars, wherein the plurality of transversal-reinforce-elements are positioned transverse to the plurality of longitudinal-reinforce-elements, and wherein the plurality of transversal-reinforce-elements are positioned parallel to the pair of forklift pocket tubes and the pair of surface members.

2. The modular pallet transport system of claim 1, wherein the plurality of transversal-reinforce-elements are positioned completely above the plurality of vertical-pillars.

3. The modular pallet transport system of claim 2, comprising a second plurality of junction-point coupling members connected to each end of the pair of horizontal connecting members.

4. The modular pallet transport system of claim 3, wherein the first plurality of junction-point coupling members connect to the second plurality of junction-point coupling members.

5. The modular pallet transport system of claim 3, wherein the basic-pallet, the plurality of vertical-pillars, the plurality of longitudinal-reinforce-elements, the first plurality of junction-point coupling members, the second plurality of junction-point coupling members, and the plurality of transversal-reinforce-elements are coated with paint or are hot dip galvanized.

6. The modular pallet transport system of claim 1, wherein the plurality of vertical-pillars comprises four vertical-pillars.

7. The modular pallet transport system of claim 1, wherein the plurality of longitudinal-reinforce-elements comprises two longitudinal-reinforce-elements.

8. The modular pallet transport system of claim 1, wherein the plurality of transversal-reinforce-elements comprises two transversal-reinforce-elements.

9. The modular pallet transport system of claim 1, comprising screws that connect the plurality of vertical-pillars to the basic-pallet and to the plurality of longitudinal-reinforce-elements takes place via screws or plug-connection.

10. The modular pallet transport system of claim 1, wherein attachment of the plurality of vertical-pillars to the basic-pallet and to the plurality of longitudinal-reinforce-elements takes place via plug-connection.

11. The modular pallet transport system of claim 1, wherein the rigid frame of the basic-pallet comprises a solid steel frame.

12. The modular pallet transport system of claim 1, wherein the pair of surface members comprise wooden top surfaces.

13. The modular pallet transport system of claim 1, wherein a width of each surface member of the pair of surface members is wider than a width of each end tube of the pair of end tubes.

14. The modular pallet transport system of claim 1, wherein a height of each surface member of the pair of surface members is less than a height of each end tube of the pair of end tubes.

15. The modular pallet transport system of claim 1, comprising a plurality of tie-down-points on each end tube of the pair of end tubes.

16. The modular pallet transport system of claim 1, comprising a position stand on an end of each of end tube of the pair of end tubes, wherein each position stand supports a vertical-pillar of the plurality of vertical-pillars.

17. The modular pallet transport system of claim 1, wherein the gap between the pair of surface members extends between the pair of end tubes without any intervening connecting members.

18. The modular pallet transport system of claim 1, wherein the pair of surface members are spaced apart from each other without an intervening connecting member other than the pair of end tubes.

19. The modular pallet transport system of claim 1, wherein each of the plurality of longitudinal-reinforce-elements comprises:

a pair of horizontal connecting members;

a pair of vertical connecting members supporting the pair of horizontal connecting members; and a diagonal connecting member connected to the pair of horizontal connecting members, wherein the diagonal connecting member is diagonally oriented with respect to the pair of horizontal connecting members and the pair of vertical connecting members.

20. The modular pallet transport system of claim 19, wherein the pair of vertical connecting members are parallel to the plurality of vertical-pillars, and wherein the pair of vertical connecting members are shorter in height than the plurality of vertical-pillars.

* * * * *